US007258326B2

(12) United States Patent
Talbott

(10) Patent No.: US 7,258,326 B2
(45) **Date of Patent: *Aug. 21, 2007**

(54) WALL MADE OF BAGEL SPLIT TIRES

(75) Inventor: Alex F. Talbott, Louisville, KY (US)

(73) Assignee: Lifenet Softwalls, LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/959,653

(22) Filed: Oct. 6, 2004

(65) Prior Publication Data

US 2005/0077506 A1 Apr. 14, 2005

Related U.S. Application Data

(60) Provisional application No. 60/509,690, filed on Oct. 8, 2003.

(51) Int. Cl.
*A01K 3/00* (2006.01)
*E01F 15/00* (2006.01)

(52) U.S. Cl. ..... 256/13.1; 256/1; 256/19; 404/6; 405/284

(58) Field of Classification Search ..... 256/1, 256/13.1, 196, 87, 94, 153, 19; 404/6, 9, 404/10; 405/21, 16, 284, 302.6, 34
See application file for complete search history.

(56) References Cited

U.S. PATENT DOCUMENTS 3,764,446 A * 10/1973 Martin ..... 428/52
3,928,701 A 12/1975 Roehner
3,934,540 A 1/1976 Bruner et al.
3,951,384 A 4/1976 Hildreth, Jr.
4,022,434 A 5/1977 Moore
4,188,153 A * 2/1980 Taylor ..... 405/34
4,629,360 A 12/1986 Cacossa et al.
4,785,577 A 11/1988 Lederbauer
5,006,014 A * 4/1991 Greenough ..... 405/72
5,011,327 A 4/1991 Thiac
5,056,961 A 10/1991 McMeans et al.
5,096,772 A 3/1992 Snyder
5,131,787 A * 7/1992 Goldberg ..... 404/32
5,178,489 A 1/1993 Suhayda
5,238,325 A 8/1993 Krenzler
5,284,326 A 2/1994 Chiovitti et al.
5,340,630 A 8/1994 Tripp
5,364,206 A 11/1994 Marienfeld
5,370,475 A * 12/1994 LeBlanc ..... 405/21
5,378,088 A 1/1995 Foehrkolb
5,480,255 A 1/1996 Bernaquez et al.
5,645,368 A * 7/1997 Yunick ..... 404/6
5,746,545 A 5/1998 Parker, Jr.
5,795,106 A 8/1998 Herd
5,834,083 A 11/1998 Pignataro
5,873,208 A 2/1999 Nowacek (Continued)

*Primary Examiner*—Daniel P. Stodola
*Assistant Examiner*—Nahid Amiri
(74) *Attorney, Agent, or Firm*—Woodard, Emhardt, Moriarty, McNett & Henry LLP

(57) ABSTRACT

Above ground fencing is constructed with slices of used tires from vehicles. There are various arrangements of tire slices and inter-slice binding and anchorage of slices in places. One use for such fencing is for roadway collision safety. One use of the tread portion of waste tires is as binding material.

20 Claims, 6 Drawing Sheets

U.S. PATENT DOCUMENTS

| | | | | |
|---|---|---|---|---|
| 5,906,359 | A | 5/1999 | Rowswell | |
| 6,151,859 | A | 11/2000 | Nowacek | |
| 6,194,519 | B1 | 2/2001 | Blalock et al. | |
| 6,268,035 | B1 | 7/2001 | Carpenter | |
| 6,370,476 | B1 * | 4/2002 | McBride | 702/14 |
| 6,372,069 | B1 | 4/2002 | Walls | |
| 6,457,912 | B1 | 10/2002 | Leibl | |
| 6,505,993 | B1 | 1/2003 | Diem | |
| 6,527,891 | B2 | 3/2003 | Khadem | |
| 6,533,501 | B1 | 3/2003 | Callinan et al. | |
| 6,558,076 | B2 * | 5/2003 | Liaw | 405/35 |
| 6,896,449 | B1 * | 5/2005 | Callinan et al. | 405/284 |
| 6,905,281 | B2 * | 6/2005 | Kang | 404/6 |
| 2005/0236609 | A1 * | 10/2005 | Talbott | |

* cited by examiner

WALL MADE OF BAGEL SPLIT TIRES

This application claims benefit of application Ser. No. 60/509,690 filed Oct. 8, 2003.

BACKGROUND OF THE INVENTION

This application is based on provisional patent application U.S. Ser. No. 60/509,690 filed Oct. 8, 2003, on which priority to the present application is claimed, and which is incorporated herein by reference.

Various applications of used tires have been invented, and some of them patented. This is discussed in my PCT Application No. PCT/US03/14967 filed May 13, 2003 and published on Nov. 27, 2003. That patent application discloses several ways for usefully dealing with vehicle tires that are no longer suitable for use on vehicles. The content of that application, is incorporated by reference herein to any extent needed. Pages 13 and 14 of that application describe the use of tire tread strips for bindings to bind tires together in a manner generally shown in FIGS. 5 and 6 of that application and the present application to make a fence or barrier. Page 13 of that PCT application also describes the use of staples to connect ends of two tire tread strips and, in that context, refers to FIG. 11 of that PCT patent application. As disclosed in that PCT application, the tires are distributed in courses and stacked somewhat like a wall of bricks, to make fences or barriers having different profiles and heights. The tires oriented with their rotational axes vertical, can be exposed to collection of water and dirt or debris in the upward facing concave portion of the lower half of the tire. To enable drainage of water from this portion of the tires, holes are provided in the downward facing sidewall. In some circumstances, some of such tires can be exposed to enough dirt and debris for it to become wet and interfere with drainage. There remains a need for improvement in that regard.

SUMMARY

Various aspects of the invention are presented here, but others may be noted even though not necessarily recited here.

According to one embodiment of the present invention, used tires are divided on a plane transverse to the axis of the tire, resulting in two tire slices. Such slices are placed in one or more rows, with the axes of the slices generally vertical, and the outside face of the sidewall portion of each slice facing upward. The slices are arranged in courses stacked upward to the height desired for the fence or wall which is built according to one aspect of the invention.

Adjacent slices in a course may be connected to each other by binding devices which may be rope or cabling or ribbons of various materials or with strips of tire treads according to another aspect of the invention.

Courses of slices are connected together by binding devices which may be with rope or cabling or ribbons of various materials or with strips of tire treads according to another aspect of the invention.

Bindings and anchorage and organization of slices and rows may be tailored to usage as highway barriers for medians or elsewhere with controlled deflection upon impact, according to another aspect of the invention.

BRIEF DESCRIPTION OF THE DRAWINGS

FIG. 15 is a perspective view of end portions of two tire tread strips having inter-fitting dovetail cut configuration for holding them together.

DESCRIPTION OF THE ILLUSTRATED EMBODIMENTS

Figure 6:
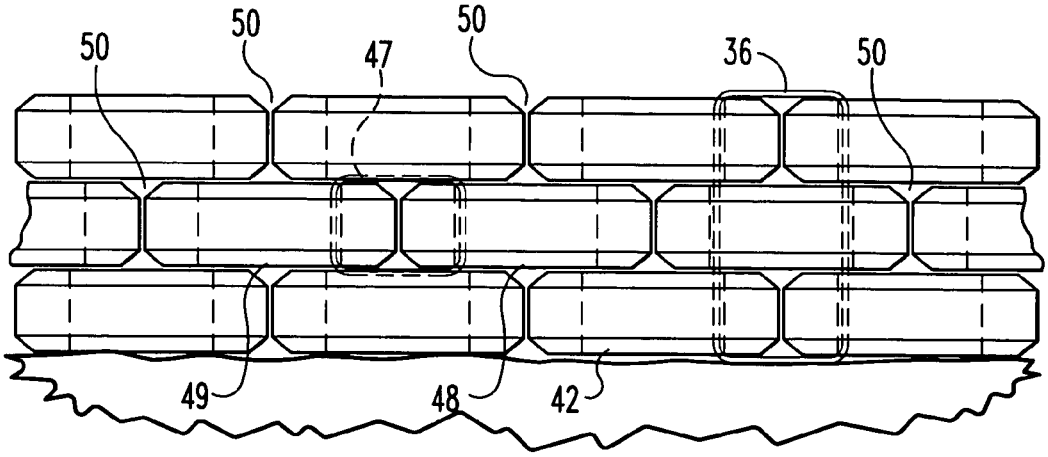
FIG. 6 is an elevation view of a wall like that of FIG. 3 but showing the wall constructed of whole tires.
Figure 5:
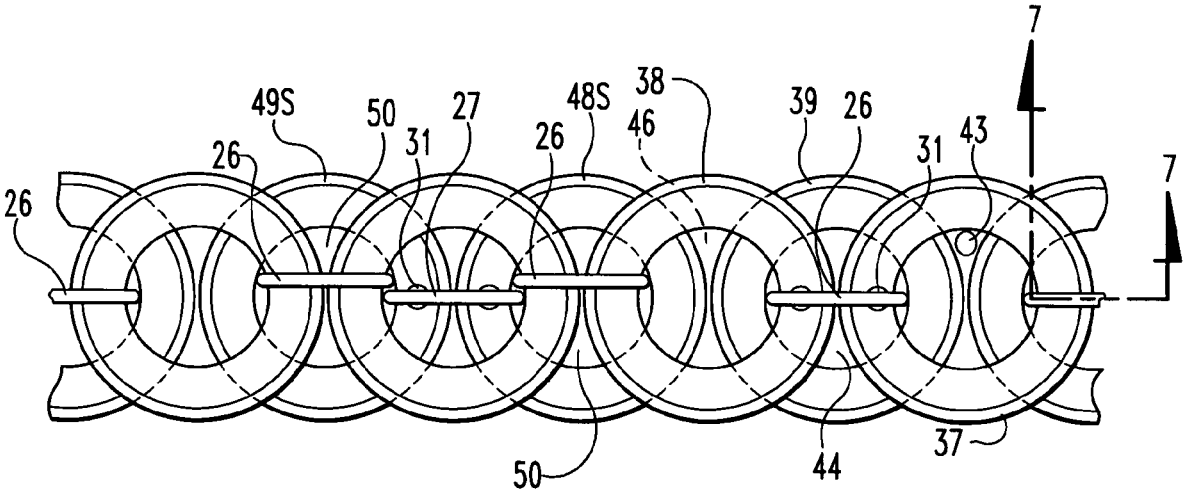
FIG. 5 is a top plan view of the wall shown in FIG. 3, the view taken at line 5-5 in FIG. 3 and viewed in the direction of the arrows.

In contrast to my previous inventions, the present invention employs used tires but, instead of whole tires as shown in FIGS. 5 and 6 of the above-mentioned PCT application, the present invention employs used tires which have been split in a plane perpendicular to the axis of the tire. For example, FIGS. 1 and 1A herein show one-half 11 of a tire with tread at 12, sidewall at 13, rotational axis 14, and wheel opening 15, all centered on the axis 14. The original tire, such as the tires in FIG. 6 herein, was split at plane 16 perpendicular to the axis 14.

Figure 2:
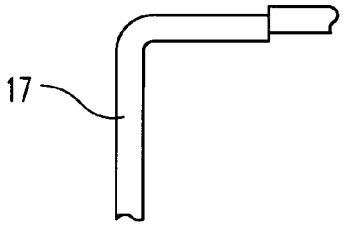
FIG. 2 is a fragmentary schematic of a piece of binding made from a tire tread.

FIG. 2 shows schematically a piece of strapping 17 made from the tread of another used tire. It represents an example of bringing together the ends of tread strips for binding slices shown in FIG. 3, immediately prior to connecting the ends of one or more tread strips in a manner such as shown, for example, in FIGS. 10 through 14.

Figure 3A:
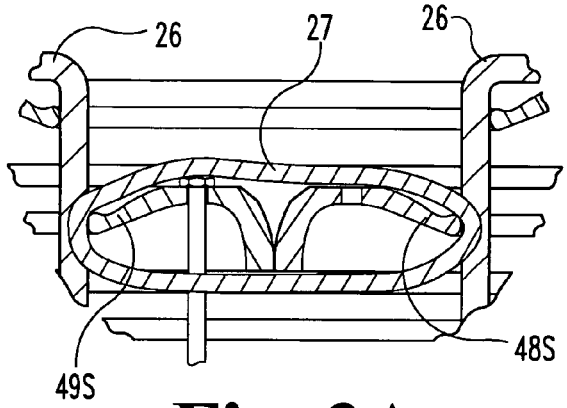
FIG. 3A is an enlarged fragment of FIG. 3 showing a loop of binding material around and coupling together adjacent tire slices in a course of slices.
Figure 3:
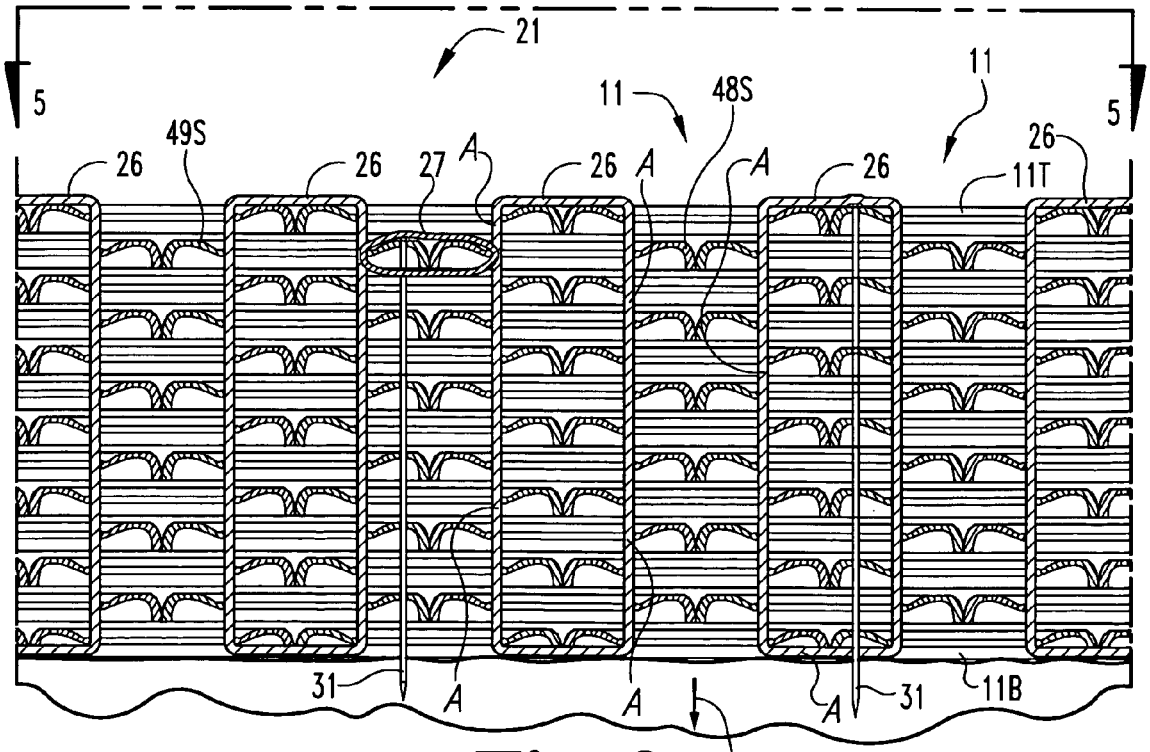
FIG. 3 is a schematic longitudinal sectional view of a portion of a wall made according to a typical embodiment of the present invention, with the section taken on a plane or planes containing the axes of the slices comprising the wall portion illustrated.

Referring now to FIGS. 3 and 5, FIG. 3 is a schematic longitudinal sectional view of a portion of a wall 21 similar to the wall of FIG. 6, but using slices 11 which have been split bagel-style, instead of whole tires such as 37 and 38 in FIG. 6. These slices 11 are stacked in the same way as in FIG. 6, but the slices in FIGS. 3 and 5 are placed with the concave surface thereof facing down in the direction of arrow 22. Thus, no water can accumulate in them. Depending on the wall height desired, the wall can be made with as many courses of slices as needed.

FIGS. 8-14 of the present application correspond to like figures of the PCT application and with the same reference numerals, but with some difference in figure numbers in the present application.

Figure 4:
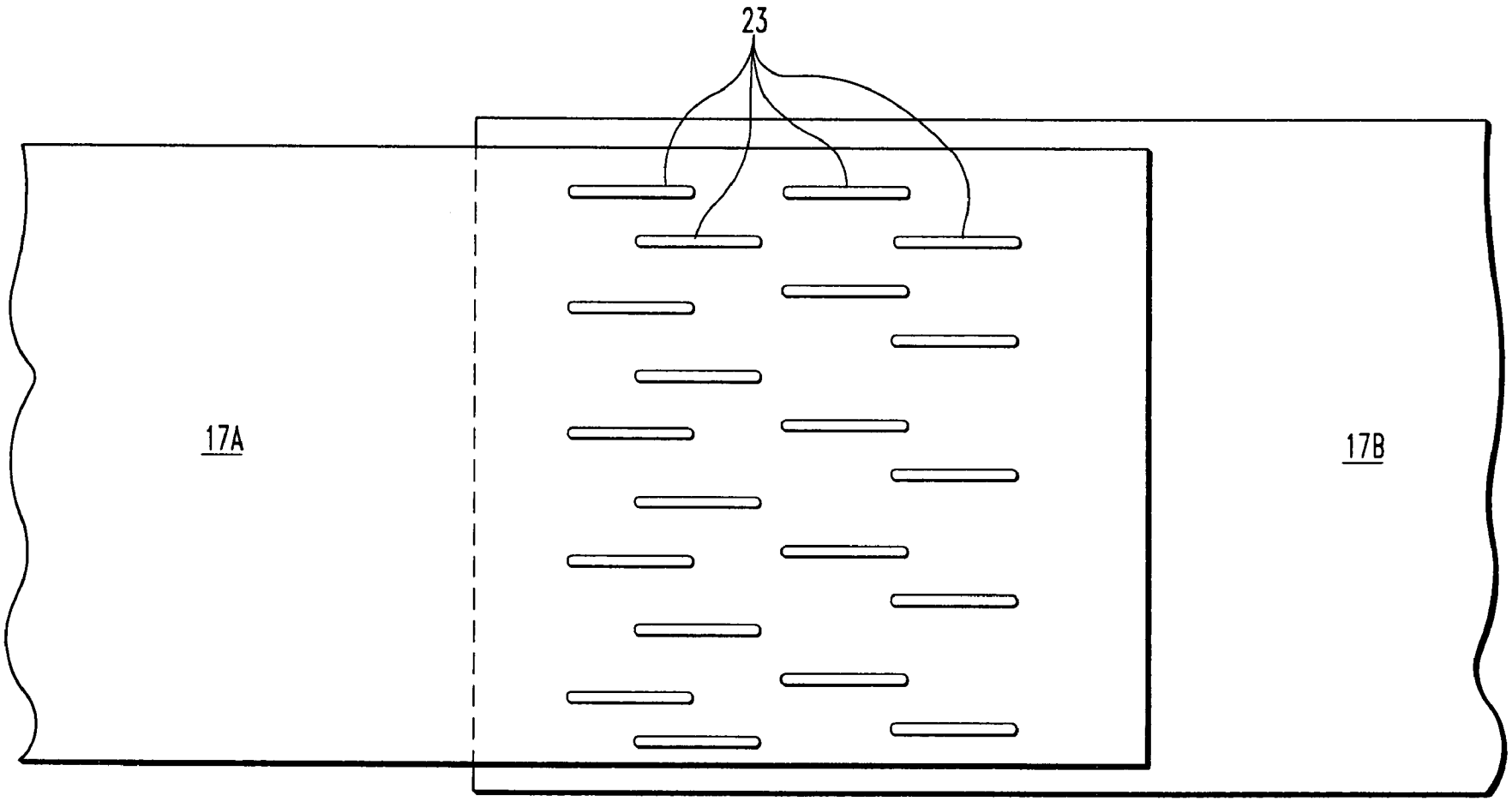
FIG. 4 is an enlarged schematic view of end portions of two tread strips (shown fragmentarily) stapled together.
Figure 10:
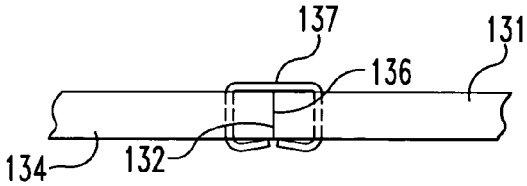
FIG. 10 is a fragmentary view of the tire treads cut from two tires and laid out flat, with two butt ends connected with staples.
Figure 12:
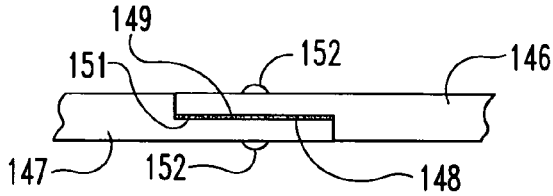
FIG. 12 is a view like FIG. 10 but with overlapping ends connected with adhesive.
Figure 13:
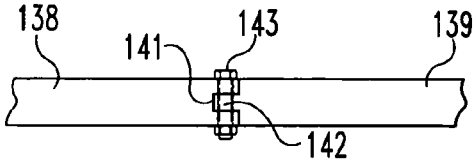
FIG. 13 is a view like FIG. 10 but with ends fitted in a mortise and tenon configuration and connected by a threaded fastener.
Figure 11:
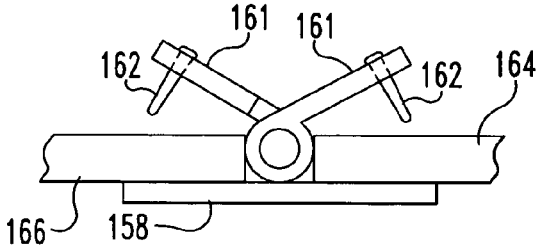
FIG. 11 is a view like FIG. 10 but with tread strip ends connected by a hinged clamp.
Figure 14:
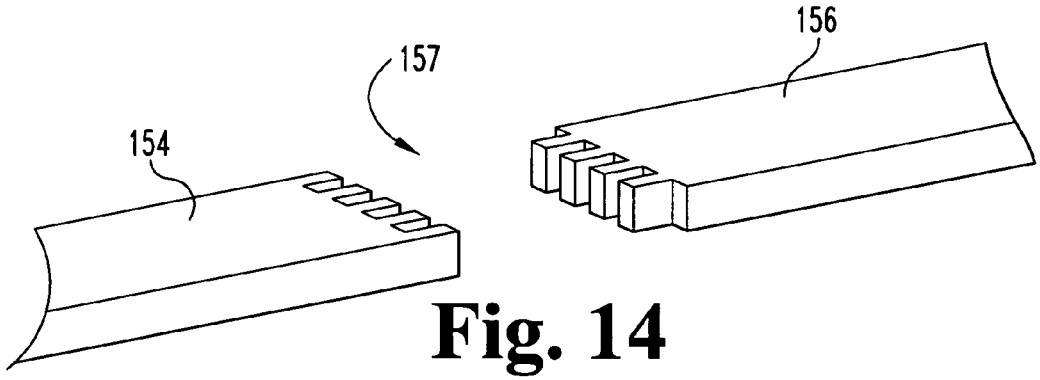

In contrast to the end-to-end relationship of the tread strips 131 and 134 shown in FIG. 10 of the present application, the tread strips employed in the practice of the present invention are preferably stapled as shown in FIG. 4. More specifically, in FIG. 4 there are two tread strips shown fragmentarily, with a portion of strip 17A overlapping the end portion of strip 17B. There are four rows of five staples 23 in each row. Of course, the prongs of the staples are driven through the two tread strip end portions and then folded over as in FIG. 10 herein, and in conventional paper stapling style, to retain the staples in the tread strips.

Depending upon the height of the wall, it is not likely that one tread strip will suffice to provide the binding from the bottom course of slices 11B to the top course of slices 11T (FIG. 3). Therefore, as many tread strips as necessary can be stapled together in the manner shown as in FIG. 4 to wrap completely around the stacks of the slices as shown at 26 in FIG. 3.

Figure 1:
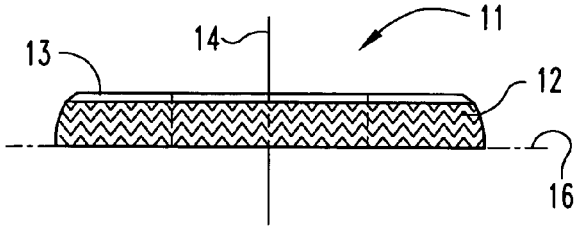
FIG. 1 is a side elevational view of a half portion slice of a tire and which is useful according to a typical embodiment of the present invention.
Figure 1A:
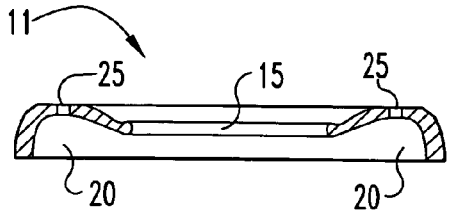
FIG. 1A is a section through the slice taken on a plane containing the axis of the slice.

The tire slices 11 were shown with solid black in the sectional views in FIGS. 1 and 3 of my provisional application, to help emphasize the location of the binding between adjacent slices. Their cross section is typical as in FIG. 1A herein but, having been cut on a plane perpendicular to the rotational axis 14 of the slice, and oriented with the concave inside surface 20 facing down as shown best in FIG. 1A, no water will collect in them. Also, while FIG. 3 shows a small vertical spacing between slices of each course and the slices of the supporting course below, this is done to better distinguish one slice from another in the drawing. It should be understood that the slices in each course are preferably stacked in direct contact with the slices in the course below them.

The above-mentioned PCT application describes in some detail, the various types of connections shown in FIGS. 10 through 14 herein. While the tire tread strips can be connected in various ways, some of which are shown in FIGS. 10 through 14 herein, it is believed that the arrangement shown in FIG. 4 herein is particularly strong. The overlapping of tread strips shown in FIG. 4 can be done anywhere within the complete loop such as 26 in FIG. 3, depending upon the height of the wall, the depth of the slices and the length of tread strips used. Just as an example, the overlapping might occur at locations A in FIG. 3.

With the tread strips woven through the bagel-sliced tire halves, a very strong wall assembly is provided, using materials that would otherwise be wasted and become an excessive burden in dumps and the like.

Figure 7:
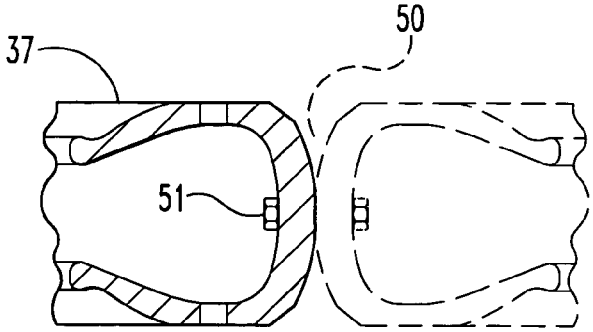
FIG. 7 is a section taken through a wall such as FIG. 6 but viewed in the direction of the arrows 7-7 in FIG. 5.
Figure 8:
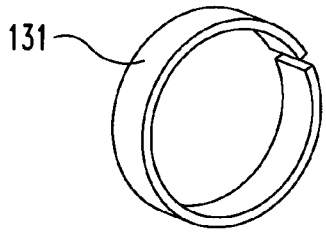
FIG. 8 is a view of a tire tread cut from the tire carcass and cut across the tread.
Figure 9:
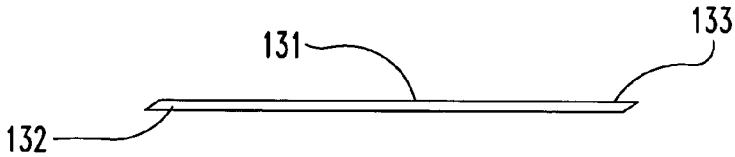
FIG. 9 is a view of the cut tire tread of FIG. 8 and laid out flat.

It should be understood that the tread strips are preferably provided in loops as at 26 in FIGS. 3 and 5. They are preferably run across the top and bottom of adjacent slices such as 37 and 38 (FIG. 5) in the top and bottom courses of the wall. The tread strips extend vertically through portions of the wheel openings of these slices which are in registry with the wheel openings of the offset slices in the alternate courses below them in the same manner as shown for the binding 36 in the tires of FIG. 6. Similarly, if desired, tread strips can be used for binding adjacent slices in a single course as at 27 in FIGS. 3 and 5 and 47 in FIG. 6. For example, a tread strip such as 27 across slices such as 48S and 49S in FIG. 5 can be looped around the slices in any course where the tread portion of one slice is in contact with or immediately adjacent the tread portion of the adjacent slice. It is believed that a connection such as bolt 51 between treads of adjacent slices in a course such as shown for whole tires in FIG. 7, might be used in the practice of the present invention, but such bolted connections seem less likely since only a slice of a tire is used in the embodiment of FIGS. 3 and 5.

Figures 15A, 15B, 15C:
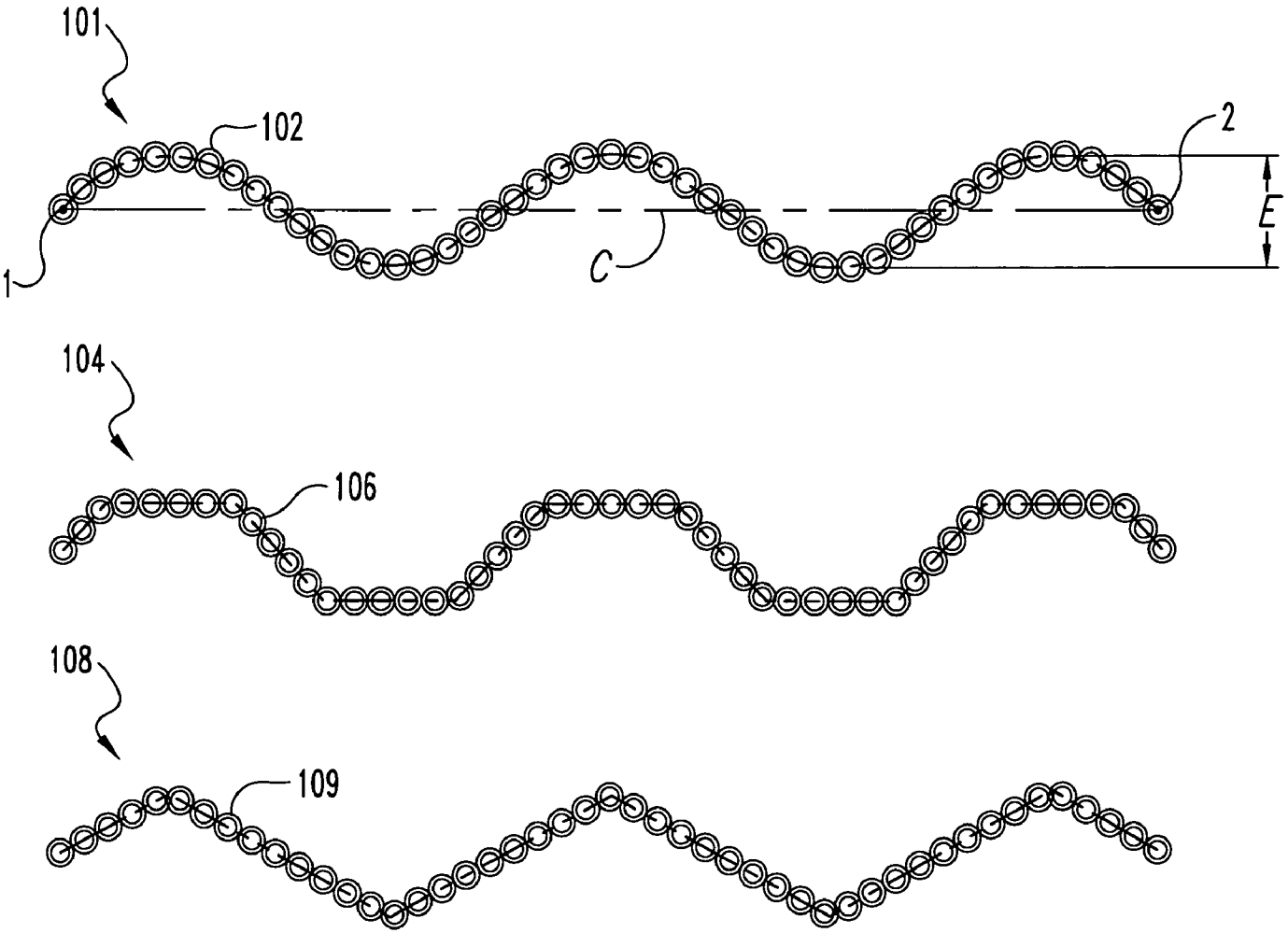
FIGS. 15A, 15B and 15C are schematic top plan views on a small scale of three different profiles of highway median fences which can be made with assemblies such as shown in FIGS. 3, 5 and 6.

Referring now to FIGS. 15A-15C and 16, FIGS. 15A-15C show three of many possible profiles of highway median fences as viewed from above. One profile example shown in FIG. 15A is a row 101 of tire slices 102 bound together with some of the kinds of bindings described above. The tire slices are placed in a sine wave type of pattern or profile. The illustration represents, for example, a highway median fence one hundred feet in length from point 1 to point 2, having a single row of stacked tire slices, and a maximum overall original excursion "E" of the original positions of the tire slices from the centerline "C" of the row, of about fourteen feet.

FIG. 15B shows a row 104 of tire slices 106 and may be referred to as a trapezoidal pattern in which the length is one hundred feet and the width from peak to peak is ten feet. FIG. 15C shows a row 108 of tire slices 109 arranged in a sawtooth profile.

Figure 16:
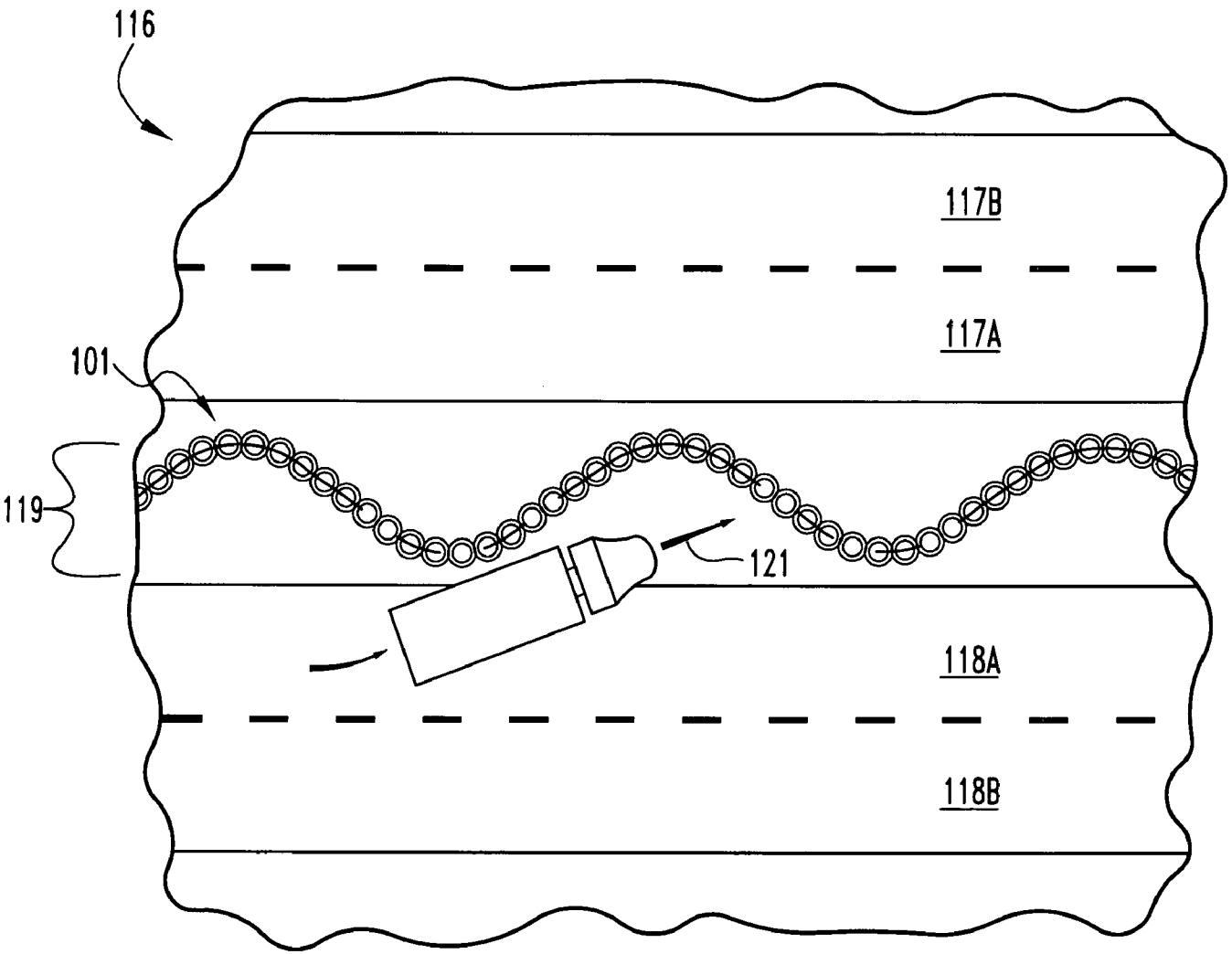
FIG. 16 is a schematic top plan view of a highway with a divider median and showing the fence of FIG. 15A in place, and showing a vehicle veering toward the fence.

FIG. 16 represents a portion of a divided highway 116, with two lanes 117A and 117B for travel in one direction, and two lanes 118A and 118B for travel in the opposite direction. A grassy median 119 is provided between the inner lanes 117A and 118A. Fence 101 according to the present invention is built on the median between the inner lanes 117A and 118A. Truck 121 is out of control and headed toward collision with the fence. As mentioned above, many different profiles can be used. Also, more than one row of tire slices may be used in a fence built according to the invention. Also, the FIGS. 3 and 5, fence built according to this invention may be built directly on the ground or on pads or bases assembled or fabricated of various natural or man-made materials. Also, while consistent with the desire for good and effective usage of used tires, tire treads would be used as binding devices. But it may be found that for other reasons, other materials may be preferred for binding devices. If desired, holes such as 25 in FIG. 1A and in FIG. 3 may be provided in the sidewalls of the tire slices, for anchoring spikes or rods or for other reasons. If desired, such holes can be produced by punching slugs or "knock-outs" from the slices, leaving the holes. While they may be made round, they may be made other shapes. Oval, elongate rectangular and diamond are just a few examples. They may be used in the fence for a variety of purposes. Examples are for leveling, for spacing between facing treads in a course, for spacing between a bottom tire slice and the ground or other support surface to facilitate drainage, or for spacing between a and a slice under it for the same, or for other reasons. If a hole is made elongate and long enough, cabling can be wrapped around the slug and the slug used as a wedge or cable tightness adjuster. Also, it is conceivable that combinations of whole tires and tire slices can be made in construction of a fence. Thus, according to the present invention, the entire used tire, as a whole or sliced, and slugs removed from it, can be put to constructive use.

While the invention has been illustrated and described in detail in the drawings and foregoing description, the same is to be considered as illustrative and not restrictive in character, it being understood that all changes and modifications that come within the spirit of the invention are desired to be protected. It should be understood that while the word "slice" is used herein, it should not be construed as limited to precisely half the original tire width from sidewall to sidewall, or to a particular method of dividing the original tire into two parts.

What is claimed is:

1. A fence comprising:

a plurality of slices of used tires, each slice being a generally half portion of a tire divided on a plane transverse to an axis of the tire, each slice having a sidewall portion with an outside face and an inside face, and each slice having a tread portion joined to said sidewall portion, and wherein:

the tread and sidewall portions are circular about said axis and have a wheel opening centered on said axis;

said slices being laid with the outside face of their sidewall portions facing upward;

said slices being arranged in at least one row having a profile, and said row having at least two courses of said slices therein; and at least one binding device connecting together two of said slices in one of said courses and holding said two of said slices together in said one of said courses.

2. The fence of claim 1 and wherein:

said binding device is flexible to enable flexibility of the row in the event of collision of a vehicle with the row, whereby those of said slices nearest the initial collision impact location and, sequentially, others of said tire slices located further from said initial impact location, are moved out of their position in the original row profile and lessen tension initially placed on the binding device by the impact of the vehicle with the fence and thereby lessen the potential for breakage of the binding device.

3. The fence of claim 1 and further comprising:

said at least one binding device connecting at least two of said slices in said one course to at least two of said slices in another of said courses in said row and located above said one course.

4. The fence of claim 1 and further comprising:

means for binding slices in a first of said courses to slices in a second of said courses.

5. The fence of claim 3 and wherein:

said slices in said another of said courses are laid atop said slices in said one of said courses, and portions of the wheel openings of said slices in said another course are in registry with the portions of the wheel openings of said slices on which they are laid.

6. The fence of claim 3 and wherein:

said slices in said another of said courses are laid atop said slices of said one of said courses, and each said slice of said another course is offset relative to the said slice on which it is laid and covers less than half of the wheel opening of the said tier on which it is laid.

7. The fence of claim 4 and further comprising:

means for tightening said means for binding and coupled to said means for binding.

8. The fence of claim 1 and further comprising:

at least a third course of said slices in said row and wherein:

said slices in said third course have wheel openings, certain ones of said slices in said third course having at least portions of said wheel openings aligned with at least portions of said wheel openings of certain ones of said slices in said first and second courses, said fence further comprising:

binding devices extending through said aligned portions of said wheel openings of said slices in the first, second and third of said courses, binding said slices together horizontally and vertically.

9. The fence of claim 8 and wherein:

said binding devices comprise elongate flexible material.

10. The fence of claim 9 and wherein:

said binding devices comprise tire tread strips.

11. The fence of claim 1 and wherein:

said at least one binding device is flexible to enable flexibility of the fence in the event of a collision of a vehicle with the fence, whereby those of said slices nearest the initial collision impact location and, sequentially others of said slices further from the said impact location, are moved out of their position in said row profile and lessen tension initially placed on the binding device by impact of the vehicle with the fence and thereby lessen the potential for breakage of the binding device.

12. A fence comprising:

a plurality of slices of used tires, each slice being a generally half portion of a tire divided on a plane transverse to an axis of the tire, each slice having a sidewall portion with an outside face and an inside face, and each slice having a tread portion joined to said sidewall portions, and wherein:

the tread and sidewall portions are circular about said axis and have a wheel opening centered on said axis;

said slices being laid with the outside face of their sidewall portions facing upward;

said slices being arranged in at least one row having a profile, and said row having at least two courses of said slices therein; and wherein:

said slices in one of said courses have tread portions thereof engaging tread portions of adjacent ones of said slices in said one course; said fence further comprising:

means coupling to one another, said adjacent slices in said one course.

13. The fence of claim 12 and wherein:

said coupling means comprise flexible binding devices looped through said wheel openings and around said sidewalls at the locations of said engaging tread portions of said next adjacent slices.

14. The fence of claim 12 and further comprising:

means for binding said adjacent slices in said one course to said slices in another of said courses.

15. An elongate fence comprising:

a first plurality of used tire slices placed in a row on a supporting surface, each slice being a generally half portion of a tire divided on a plane transverse to an axis of the tire, each of the slices having a sidewall and a wheel opening concentric with the sidewall about said axis, and the row having a profile;

each of said slices being disposed with its said axis generally vertical and its said sidewall facing upward; and means holding said slices together in said row.

16. The fence of claim 15 and further comprising:

a second plurality of used tire slices placed on top of said slices of said first plurality; and means holding said slices of said first and second pluralities together.

17. The fence of claim 16 and wherein:

said slices of said first plurality are supported in an original position by the ground;

said fence further comprising:

at least one anchor coupled to at least one of said slices of said first plurality and to the ground to limit movement of said at least one slice relative to the ground.

18. The fence of claim 17 and wherein:

said anchor extends through a slice of said second plurality above said at least one slice to stabilize in part by said anchor, said slice of said second plurality.

19. The fence of claim 18 and further comprising:

additional anchors having portions fixed relative to the ground and having portions which extend through holes in additional ones of said slices of said second plurality whereby said additional ones of said slices of said second plurality are stabilized in original positions in said row.

20. The fence of claim 19 and wherein:

said additional ones of said slices are placed in series along said row and affixed to establish an original arrangement of slice positions determining a profile of said row.

* * * * *